US007824084B2

(12) United States Patent
McDowell

(10) Patent No.: US 7,824,084 B2
(45) Date of Patent: Nov. 2, 2010

(54) LIGHTING FIXTURE WITH DECORATIVE ELEMENTS

(75) Inventor: Mark McDowell, Springfield, MO (US)

(73) Assignee: Blumberg Industries, Inc., Miami Lakes, FL (US)

( * ) Notice: Subject to any disclaimer, the term of this patent is extended or adjusted under 35 U.S.C. 154(b) by 0 days.

(21) Appl. No.: 12/014,416

(22) Filed: Jan. 15, 2008

(65) Prior Publication Data

US 2008/0170390 A1 Jul. 17, 2008

Related U.S. Application Data

(60) Provisional application No. 60/880,583, filed on Jan. 16, 2007.

(51) Int. Cl.
*F21S 8/06* (2006.01)

(52) U.S. Cl. ..... 362/405; 362/406; 362/249.14; 362/249.16

(58) Field of Classification Search ..... 362/249, 362/404, 405, 406, 806, 249.01, 249.14, 362/249.16; D26/138, 142, 143, 145, 146
See application file for complete search history.

(56) References Cited

U.S. PATENT DOCUMENTS 2,428,975 A * 10/1947 Lamb ..... 362/573
4,034,216 A 7/1977 Webster et al.
RE33,471 E 12/1990 Herst et al.
RE33,593 E 5/1991 Herst et al.
5,318,009 A * 6/1994 Robinson ..... 600/241
5,911,498 A 6/1999 Shemitz et al.
6,210,022 B1 4/2001 Howard
6,241,370 B1 * 6/2001 Bayer et al. ..... 362/405
6,419,378 B1 7/2002 Wedell et al.
6,558,023 B2 5/2003 Casciani et al.
6,641,280 B2 * 11/2003 Hanson et al. ..... 362/186
6,712,490 B2 * 3/2004 Bayer ..... 362/405
7,195,374 B2 3/2007 Saccomanno et al.
7,217,021 B2 5/2007 Lee
7,217,023 B2 5/2007 Iwasa et al.

(Continued)

FOREIGN PATENT DOCUMENTS

CN 2676030 Y 2/2005

(Continued)

OTHER PUBLICATIONS

International Search Report for PCT/US2008/000492 dated Jun. 19, 2008.

(Continued)

*Primary Examiner*—Thomas M Sember
(74) *Attorney, Agent, or Firm*—McCormick, Paulding & Huber LLP

(57) ABSTRACT

A lighting fixture includes a support frame and a plurality of elongated, light-enhancing, decorative elements. Each of the decorative elements has a proximal portion, a distal portion and a curvilinear central axis extending therebetween. The proximal portions of the decorative elements are rigidly affixed to the support frame. The distal portions of the affixed decorative elements are unsupported and curve away from the support frame. The support frame may include elongated arms, and the decorative elements may be affixed to the support frame via the arms. The decorative element may be fabricated of crystal.

20 Claims, 5 Drawing Sheets

U.S. PATENT DOCUMENTS

| | | | | |
|---|---|---|---|---|
| 7,243,886 | B2 * | 7/2007 | Bayer et al. | 248/200 |
| 2002/0154507 | A1 | 10/2002 | Bayer | |
| 2003/0156431 | A1 * | 8/2003 | Gozum et al. | 362/582 |
| 2004/0151001 | A1 * | 8/2004 | Wu | 362/405 |
| 2004/0151002 | A1 | 8/2004 | Garber et al. | |
| 2006/0209532 | A1 | 9/2006 | Hardgrave | |

FOREIGN PATENT DOCUMENTS

| | | | |
|---|---|---|---|
| JP | 2005-158486 | A2 | 6/2005 |
| KR | 20-0431105 | | 11/2006 |

OTHER PUBLICATIONS

Chinese Office Action dated May 12, 2010 issued in parallel Chinese application.

* cited by examiner

LIGHTING FIXTURE WITH DECORATIVE ELEMENTS

CROSS REFERENCE TO RELATED APPLICATIONS

Applicant hereby claims priority benefit under 35 USC §119 from U.S. Provisional Patent Application Ser. No. 60/880,583 filed on Jan. 16, 2007, the contents of which are incorporated by reference herein.

FIELD OF THE INVENTION

The invention relates to arrangements for mounting elongated decorative elements to a frame, and more particularly to arrangements for mounting decorative elements which are light-enhancing.

BACKGROUND OF THE INVENTION

A wide variety of lighting fixtures are known, including, for example, chandeliers, sconces or other wall mounted fixtures, swags, floor and table mounted lamps, and candelabras or other candle holders. Lighting fixtures include a light source and a supporting frame.

Certain lighting fixtures, most notably chandeliers, include light reflecting decorative elements, for example, beads, crystals, pendants, baguettes, etc. to reflect or refract light and form an overall ornamental appearance. Many of these decorative ornaments have prismatic aspects.

It is known to attach decorative ornaments to frames via wires and hooks to allow the ornaments hang loosely from the frame. Another known method uses clips to grip the ornaments around their center of gravity. It is also known to attach flexible strings of ornaments along the arms of the frame.

SUMMARY OF THE INVENTION

The present invention has as a basic object to provide a lighting fixture in which elongated decorative elements are affixed to the fixture in a manner that enhances the appearance and decorative features of the elongated elements. The elements may be affixed so that they project from the fixture in cantilever fashion or in a position which places the elements in alignment with the adjacent supporting structure.

The object of the invention is accomplished in one aspect by a lighting fixture having an elongated arm, said arm having a proximal end, a distal end and a longitudinal axis extending therebetween. The fixture also has an elongated, decorative element, which may be light-enhancing, with a proximal portion, a distal portion and a central axis extending therebetween. The proximal portion of the decorative element is affixed to the arm such that said distal portion of the affixed decorative element is cantilevered from said arm. In this manner the decorative element is given maximum exposure to light which accentuates its decorative qualities.

The fixture may include a plurality of the decorative elements distributed over a plurality of arms with several decorative elements on a single arm. The decorative elements may also be affixed to the arms in general alignment with the arms.

BRIEF DESCRIPTION OF THE DRAWINGS

The invention will be readily understood from the following detailed description of aspects of the invention taken in conjunction with the accompanying drawings of which.

DESCRIPTION OF THE PREFERRED EMBODIMENTS

Figure 1:
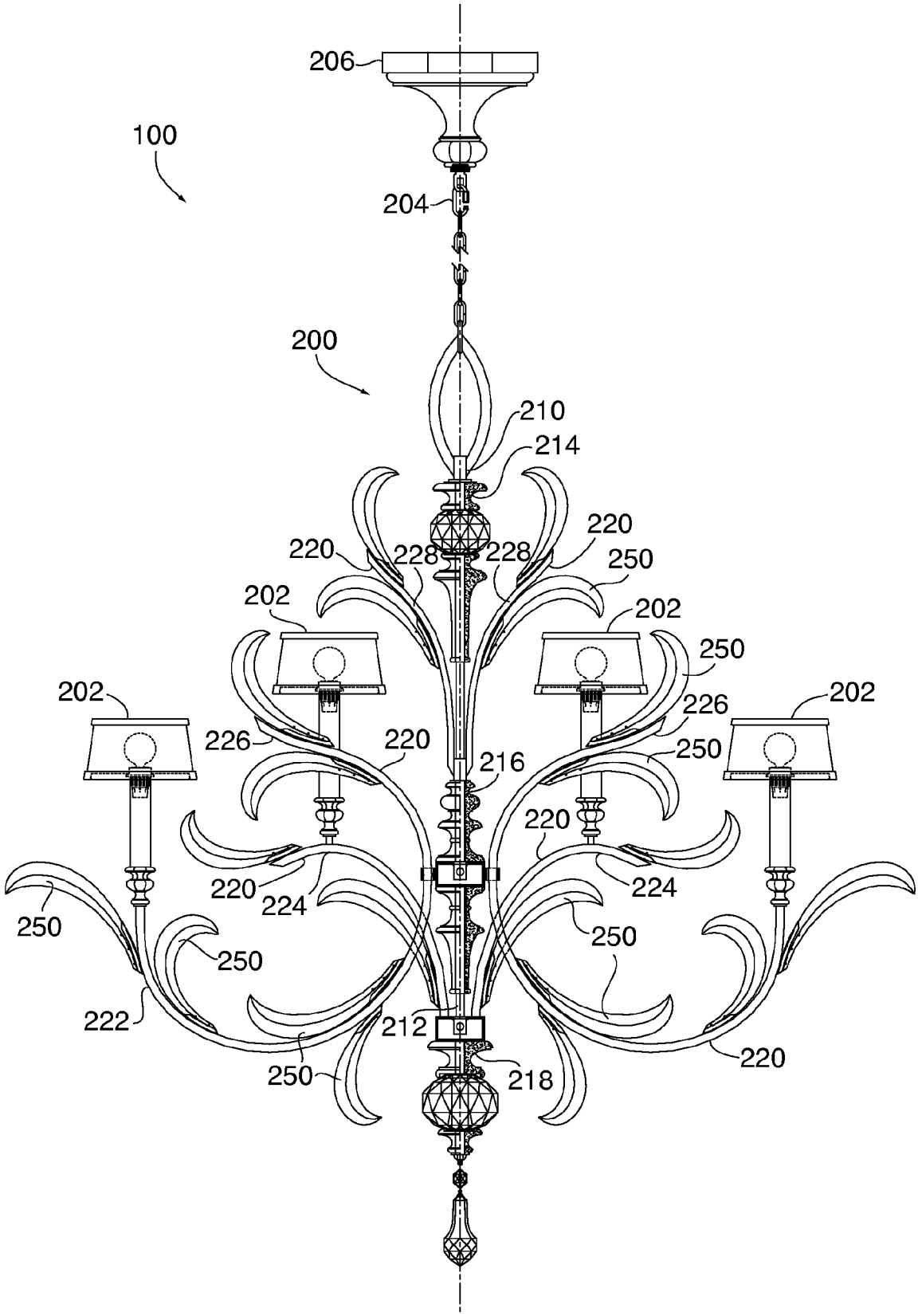
FIG. 1 is a schematic view of a lighting fixture according to one embodiment of the invention.

FIG. 1 shows a lighting fixture 100 according to a first embodiment of the invention. In this particular figure, the lighting fixture 100 is a chandelier 200 having multiple light sources 202.

Chandelier 200 is shown with a support frame 210 for supporting light sources 202. Support frame 210 has a central elongated rod 212. Rod 212 may be formed of one or more segments and may include secondary or subsidiary elements, such as attachment fittings 214, 216 and 218. Other, more decorative elements, such as breaks, fonts and prisms, may also be supported by rod 212. In FIG. 1, rod 212 is shown being supported from a chain 204, which in turn is supported from a ceiling mount 206.

Support frame 210 further includes a plurality of arms 220. Arms, which are attached directly or indirectly to rod 212, are typically elongated members having a proximal end, a distal end, and a longitudinal axis extending therebetween. The proximal end is defined as that end of the arm 220 that is mounted closest to rod 212. In general, the distal end is a free end. Each arm 220 has a cross section, which may vary or be constant down the arm length.

As shown in FIG. 1, chandelier 200 may include a variety of arms 220, which are attached to rod 212 in a variety of configurations. Some of the arms 220 may support light sources 202. For example, arm end portions 222 and 224 support light sources 202 at or near their distal ends, while arm end portions 226 and 228 do not support light sources.

Figure 2:
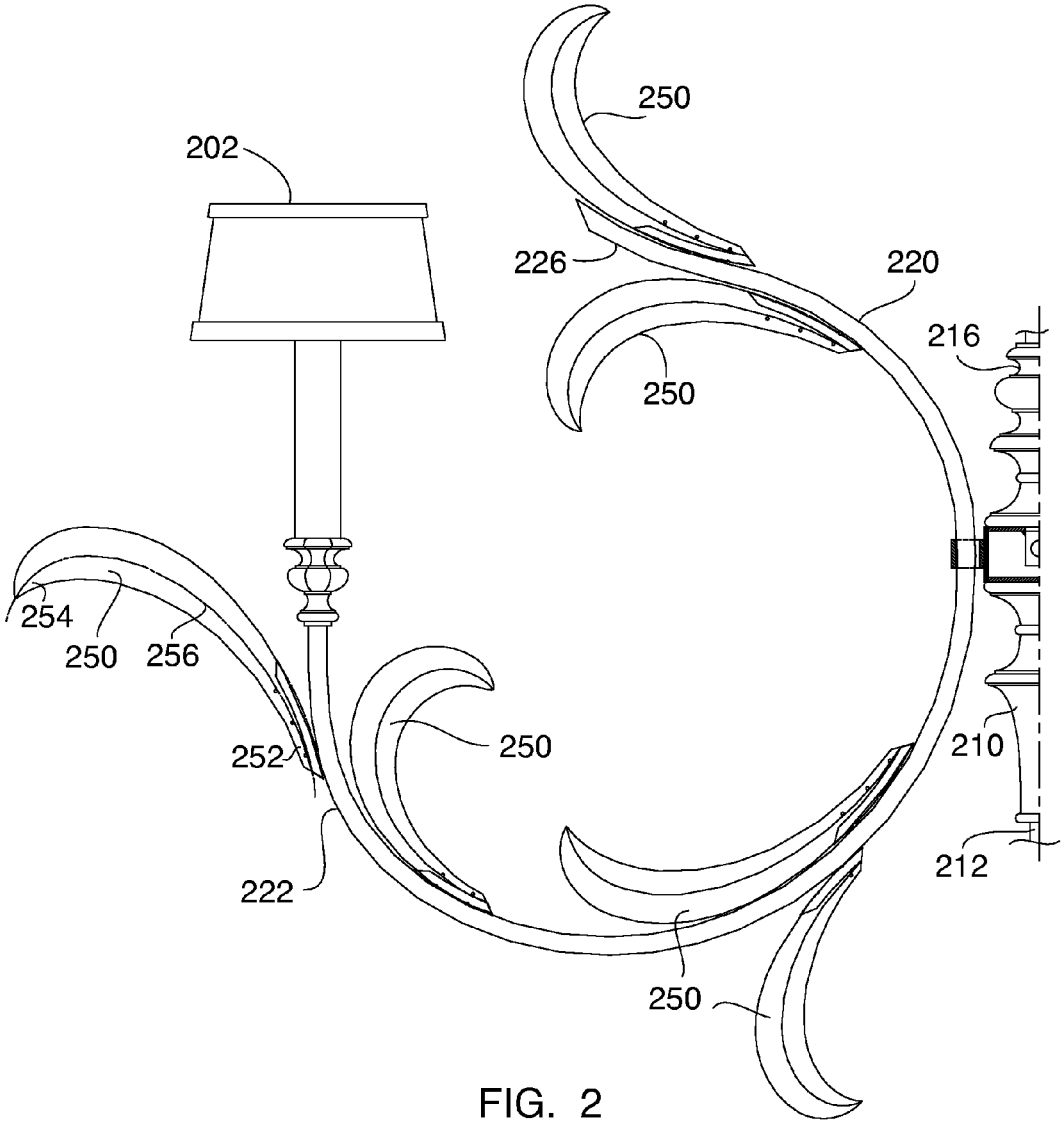
FIG. 2 is a schematic view of a portion of FIG. 1 showing one arm of the lighting fixture.

In the embodiment shown in FIGS. 1 and 2, arms 220 having end portions 222 and 226 are attached to rod 212 at a common attachment fitting 216. In one aspect, the arms 220 having the end portions 222 and 226 may be coupled to each other via this common attachment point. In another aspect, the arms 220 having the end portions 222 and 226 may be manufactured as a single member, i.e. the arms may be jointly formed as an integral, unitary member. As shown in FIG. 1, the arms 220 having the end portions 224 are attached indirectly to the rod 212 at attachment fitting 218. Arms 220 having the end portions 228 are attached to the rod 212 above the attachment fitting 216. The arms 220 may be mechanically fastened, directly or indirectly, to the rod 212. For example, the arms 220 may be inserted into sockets and/or, optionally, secured with pins or set screws. Alternatively, the arms 220 may be welded, brazed, or adhesively or otherwise fastened to the rod 212 or other attachment fittings.

Rod 212 and the arms 220 may be fabricated from metal, plastic, ceramic, glass, wood, or any other suitable material. Rod 212 and the arms 220 must have sufficient stiffness to support their own weight and the weight of any light sources 202 and/or other elements attached thereto. In one embodiment, both rod 212 and arms 220 are fabricated from extruded or drawn metal tubing. Rod 212 and arms 220 are preferably formed of hollow tubing, such that electrical wires may be routed therethrough if the light sources 202 are electrically energized.

In one aspect, the longitudinal axis of the arms 220, i.e. that axis that extends down the length of the arms from the proximal end to the distal end, is curved. The arms may curve in one or more directions. Further, the curvature need not be constant, but may vary along the length of the arms. For example, in FIG. 1, arm 220 having end portion 222 is shown with a single direction of curvature. At the proximal end of the arm 220 (i.e. close to attachment fitting 216), the degree of curvature (i.e. the slope) of the arm is less than the degree of curvature farther away from the attachment fitting. At the termination of the end portion 222, (i.e. at the distal end of the arm) the curvature goes to zero. In other words, at the distal end of arm 220, the arm is substantially straight where it is attached to light source 202. As another example in FIG. 1, arm 220 having end portion 226 is shown have two directions of curvature. At the proximal end of the arm 220, the arm curves in a first direction; at the distal end of arm 220, the end portion 226 curves in a second direction. Between the two directions of curvature lies an inflection point. As another example, the arm 220 having the end portion 224 in FIG. 1 has a single direction of curvature and close to its proximal end, where it is coupled to attachment fitting 218, the arm substantially straightens out (i.e. its curvature or slope goes to zero or near-zero).

Chandelier 200 includes a plurality of elongated decorative elements 250. One object of the invention is to provide for the attachment of the decorative elements 250 to frame 210 with maximum exposure to light from the sources 202 and natural light. In one aspect, the attachment is configured to rigidly affix the decorative element to arms 220. In another aspect, the attachment is configured to react (or carry) a moment load (i.e. a couple) at one end of the elongated decorative element such that a projecting portion of the decorative element may be cantilevered and project freely in unsupported fashion from the point of attachment.

Figure 3A:
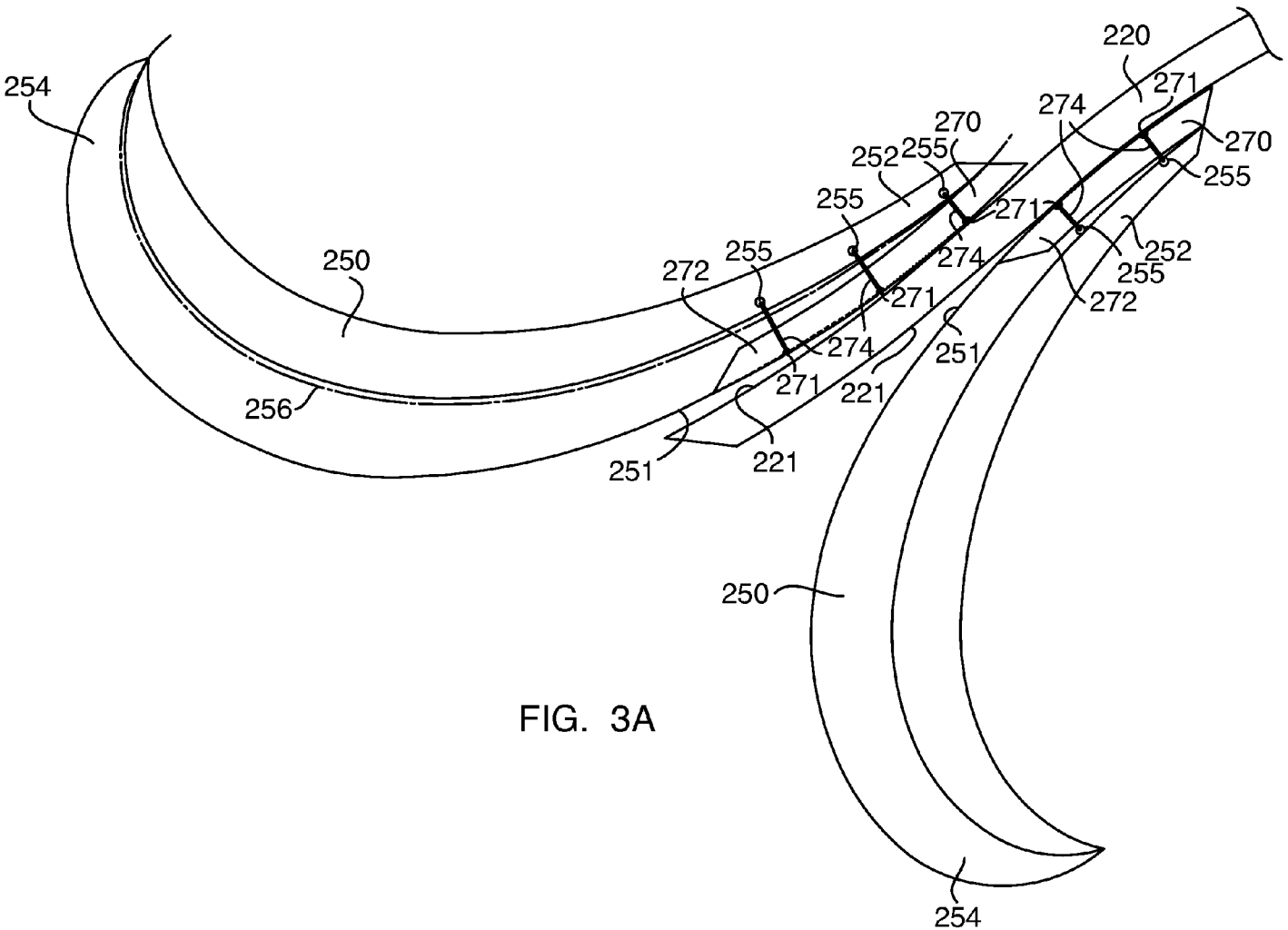
FIG. 3A is a schematic view of a distal portion of an arm with decorative elements attached to the arm according to one embodiment of the invention.
Figures 3B, 3C, 3D:
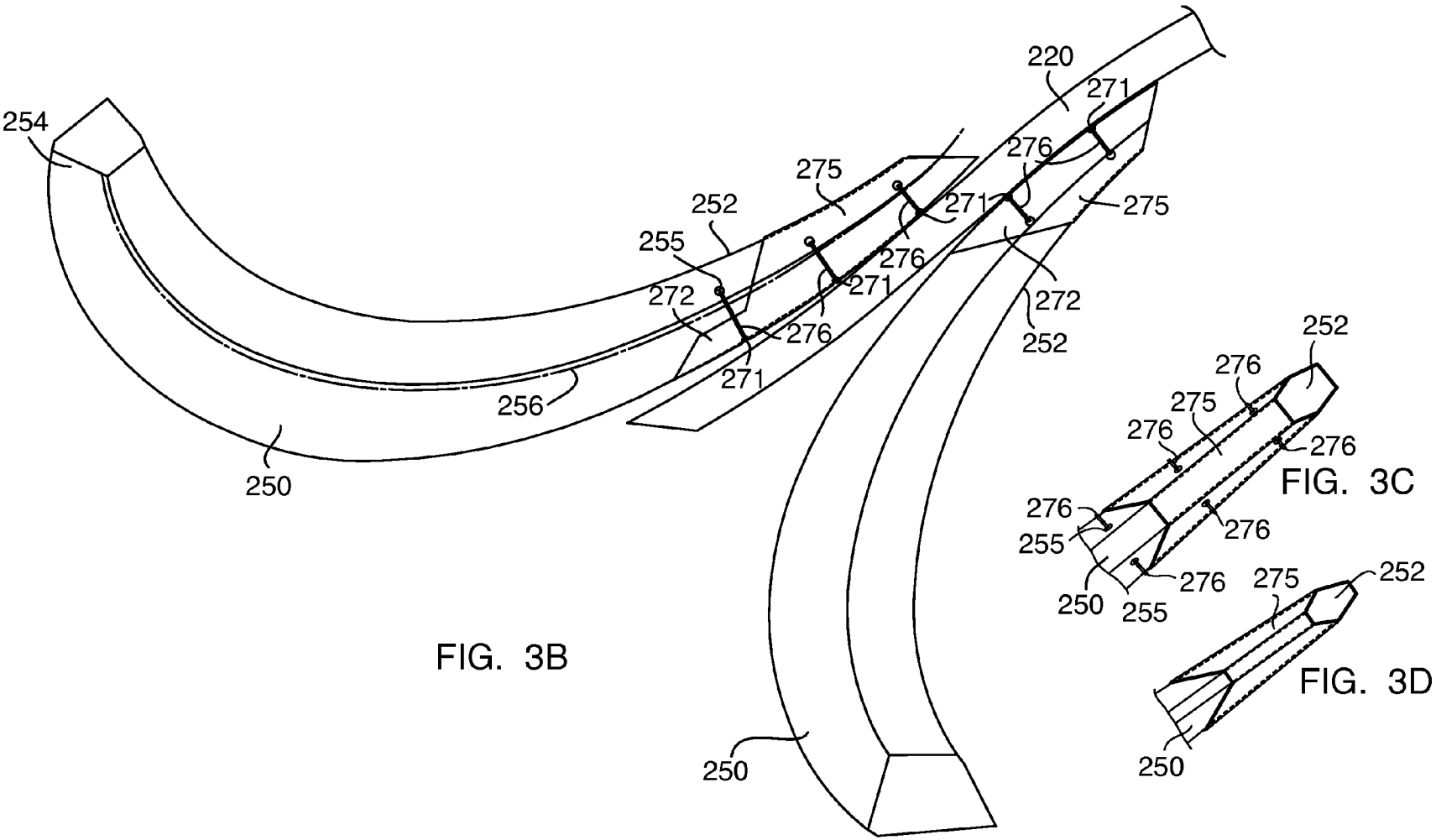
FIG. 3B is a schematic view of a distal portion of an arm with decorative elements attached to the arm according to another embodiment of the invention.
FIGS. 3C and 3D are fragmentary plan views of the attachment elements and decorative elements shown in FIG. 3B.

As shown in FIGS. 1 and 2 and also in FIGS. 3A and 3B, each elongated decorative element 250 has a proximal portion 252, a distal portion 254 and a central axis 256 extending therebetween. The proximal portion 252 is that portion of the decorative element 250 that is located adjacent to arm 220 or frame 210. The distal portion 254 is that portion of element 250 that is located at the projecting end of element 250 opposite from proximal portion 252. Each decorative element 250 has a cross section, which may vary or be constant along the length of the element. As used herein, elongated means that the length of the element is at least twice as long as its next largest dimension (width or depth). Preferably, the length of the elongated element is four or more times its next largest dimension.

In one aspect, decorative element 250 is curvilinear. As used herein, curvilinear means that at least a portion of the central axis 256 is curved.

In another aspect, the decorative element 250 is rigid, in that it can support its own weight without flexing. It may be formed as a unitary piece or from a plurality of pieces rigidly attached to one another, such as by gluing, brazing, or mechanical fastening.

In still another aspect, the decorative elements 250 are light enhancing, i.e. the decorative elements reflect and/or refract light. Each decorative element may be faceted or unfaceted, clear or colored, transparent or translucent, mirrored or partially mirrored, or any combination thereof. A preferred material for decorative elements 250 is a medium-to-high lead-content crystal, but other materials capable of reflecting or refracting light may be used. As non-limiting examples, clear or colored glass, clear or colored plastic, and mirrored glass or plastic, may be suitably configured to reflect and/or refract light.

The decorative element may taper gradually to a point at the distal end as shown in FIG. 3A, or may be blunt at the distal end as well as at the proximal end and terminate with an oblique facet or facets as shown in FIG. 3B.

As shown in FIG. 3A, two faceted, curvilinear, elongated decorative elements 250 are attached to a distal end of an arm 220. The attachment may be configured to approximately align a lengthwise extending surface 251 of the proximal portion of the elongated, decorative element 250 with a longitudinally extending surface 221 of arm 220 in the vicinity of the attachment. In other words, in the vicinity of the attachment of element 250 to arm 220, the lengthwise curvature of the surface (e.g., a faceted side, an edge between facets sides, or an unfaceted side) of the elongated, decorative element 250 is oriented such that it approximately compliments the longitudinal curvature of arm 220. This approximate correspondence between curvatures encompasses differences of up to 25 degrees over a span of up to an inch. Typically differences of 5-15 degrees over a span of up to an inch are preferred.

In FIGS. 3A and 3B, the proximal portions of the curvilinear elements 250 are shown attached to arms 220 via attachment elements. Attachment element may be a bracket 270 in FIG. 3A, or a bracket 275 in FIG. 3B, that forms a curved channel, wherein the curve of the bracket substantially corresponds to or compliments the curve of the proximal portion 252 of element 250. In one aspect, the curve of the bracket also substantially corresponds to the curve of the arm 220 in the vicinity of its attachment to bracket.

The attachment element may be fabricated from metal or other suitable materials. In one aspect, attachment element is welded, brazed, riveted or otherwise fastened to arm 220. In other aspect, attachment element 270 may be integrally formed with arm 220.

Figure 4A:
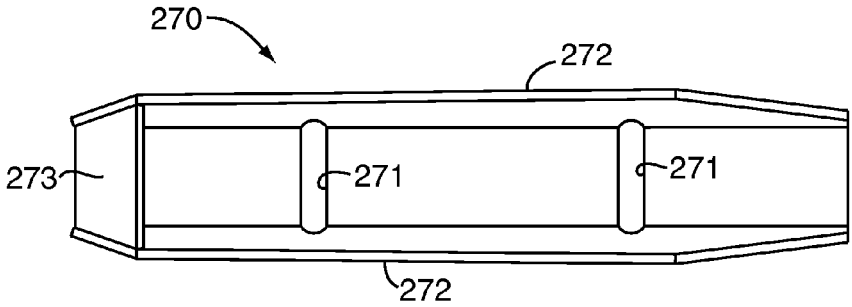
FIGS. 4A, 4B, and 4C are detailed views of one attachment element.
Figure 4B:
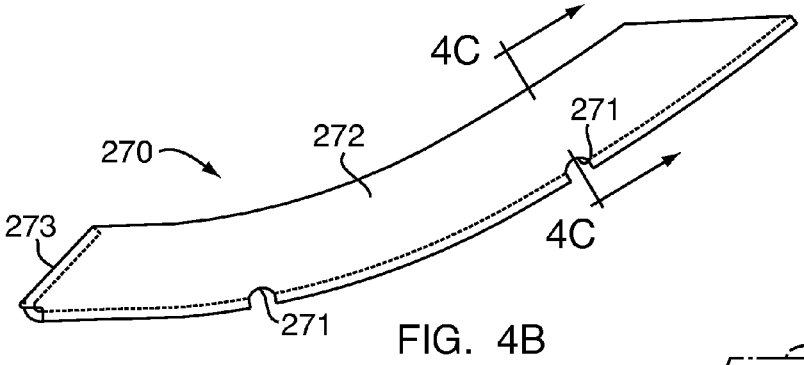
Figure 4C:
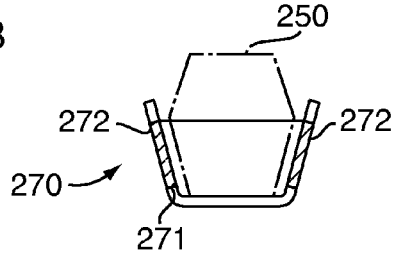
Figure 4D:
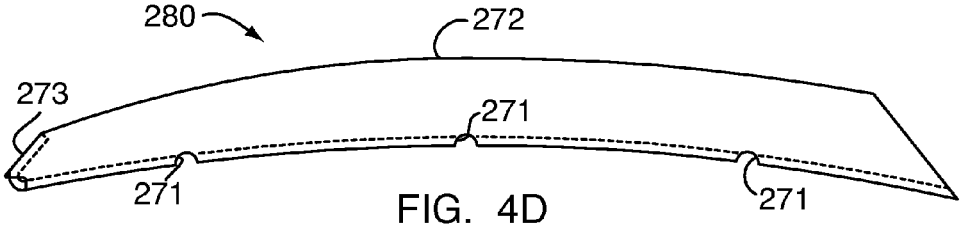
FIGS. 4D and 4E are detailed views of another attachment element.
Figure 4E:
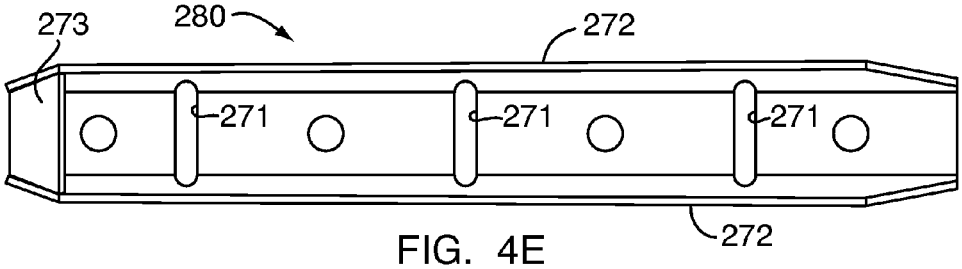

The brackets may be formed as an open channel as shown in FIGS. 3A and 4A-4E. The cross-sectional shape of the bracket channel conforms to the cross-sectional shape of the proximal portion of decorative element 250. In FIGS. 3A and 4C, the sides 272 of brackets 270 are shown wrapped at least partially around the sides of element 250 and extending at least partially toward the central axis 256. Also shown in FIGS. 4A and 4B are an optional flap 273 at the proximal end of bracket 270, and optional transverse slots 271 for accommodating passage of a wrapping wire (as described below). The bracket 270 shown in FIGS. 4A and 4B accommodates attachment of the elongated element 250 along the inner curvature of the arm, while a similar bracket 280 shown in FIGS. 4D and 4E accommodates attachment of the elongated element along the outer curvature of the arm.

Alternatively, the attachment element may form a bracket 275 which defines a closed, or mostly closed, channel or socket for the decorative element as shown in FIGS. 3B, 3C and 3D. In FIG. 3B, the sides of the bracket are shown wrapped up and around the sides of decorative elements 250 and meeting, or alternatively approaching, each other on the side of the element 250 opposite the arm 220. FIG. 3C shows the bracket and side of the element 250 which is on the top of the arm in FIG. 3B, and FIG. 3D shows the bracket and side of the element 250 which is on the bottom of the arm in FIG.

3B. These mounting arrangements may be particularly useful when mounting very long and/or very heavy elements 250 to arms 220.

As best shown in FIG. 3A, one or more holes 255 may extend through the proximal portion 252 of elements 250. These holes may be drilled after formation of the decorative elements 250, or integrally formed during the manufacture of the elements. Wires 274 may be inserted through these holes and through or around attachment elements 270 to further secure elements 250 to the arms 220. Alternatively, as best shown in FIG. 3B, small wire clips 276 may be brazed or otherwise fastened to, or formed with, the attachment elements 275 to assist in retaining elements 250 to attachment elements. The wire clips 276 may elastically deform to allow positioning of elements 250 within attachment element 275, and then snap into holes 255 such that a portion of the clip extends at least partially into hole 255. Other mechanical means may be used to assist in retaining element 250 to attachment element and arm. Optionally, adhesive may be used to assist, or further assist, in retaining the decorative elements 250 to the attachment elements 270 or 275 and the arms 220.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A branched lighting fixture having a plurality of elongated arms comprising:

at least one of said elongated arms having a proximal end, a distal end and a longitudinal axis extending therebetween; and at least one elongated, light-enhancing, decorative element having a proximal portion, a distal portion and a central axis extending therebetween;

wherein the proximal portion of the at least one decorative element is affixed to the at least one arm to form a connection such that said distal portion of the affixed decorative element is cantilevered from said arm; and wherein said distal portion of said affixed decorative element extends longitudinally beyond said distal end of said arm.

2. The branched lighting fixture of claim 1, wherein at least a portion of said central axis of said affixed decorative element is curvilinear and curves away from the longitudinal axis of said arm to which the decorative element is affixed.

3. The branched lighting fixture of claim 1, wherein said central axis of said affixed decorative element lies in a plane of said longitudinal axis of said arm to which said decorative element is affixed.

4. The branched lighting fixture of claim 1, wherein, in the vicinity of the connection between the arm and the decorative element, a surface of said affixed decorative element approximately compliments a surface of said arm along the longitudinal direction of said arm.

5. The branched lighting fixture of claim 1, wherein at least a portion of said longitudinal axis of said arm is curvilinear.

6. The branched lighting fixture of claim 1, wherein said affixed decorative element has multiple facets, and wherein at least one of said facets is non-planar.

7. The branched lighting fixture of claim 1, wherein said affixed decorative element is fabricated from crystal.

8. The branched lighting fixture of claim 1, wherein said affixed decorative element has multiple lengthwise facets extending from said proximal portion to said distal portion, and wherein every said lengthwise facet is non-planar.

9. The branched lighting fixture of claim 1, wherein the distal portion of said affixed decorative element tapers to a point.

10. The branched lighting fixture of claim 1, wherein the distal portion of said affixed decorative element terminates in an oblique facet or facets.

11. The branched lighting fixture of claim 1, wherein said affixed decorative element has at least two holes extending through said proximal portion to attach said decorative element to said arm.

12. The branched lighting fixture of claim 1, further including an attachment element located between said arm and said affixed decorative element, said attachment element adapted to receive said proximal portion of said decorative element.

13. The branched lighting fixture of claim 12, wherein said attachment element is complementarily curved to the proximal portion of said affixed decorative element.

14. The branched lighting fixture of claim 12, wherein the at least one arm further includes at least one longitudinal surface extending between said proximal end and said distal end;

wherein the at least one decorative element further includes at least one elongate surface extending between said proximal portion and said distal portion;

wherein said proximal portion of said decorative element is attached said arm such that, in the vicinity of attachment, said elongate surface of said decorative element is approximately aligned with said longitudinal surface of said arm; and wherein attachment element is complementarily curved to the proximal portion of said affixed decorative element.

15. The branched lighting fixture of claim 1, wherein said decorative element is configured to refract light.

16. The branched lighting fixture of claim 1, wherein said decorative element is configured to reflect light.

17. The branched lighting fixture of claim 1, further including at least one electric light mounted on the arm.

18. The branched lighting fixture of claim 1, further including a supporting frame member, and the at least one arm is attached to said supporting frame member.

19. The branched lighting fixture of claim 18, wherein said supporting frame member is configured for attachment to a wall.

20. The branched lighting fixture of claim 18, wherein said supporting frame member is configured for attachment to a ceiling.

* * * * *